US005359957A

United States Patent [19]

Askestad

[11] Patent Number: 5,359,957

[45] Date of Patent: Nov. 1, 1994

[54] TURRET FOR DRILLING OR PRODUCTION SHIP

[75] Inventor: Sigmund Askestad, Saetre, Norway

[73] Assignee: Norsk Hydro a.s., Oslo, Norway

[21] Appl. No.: 70,348

[22] PCT Filed: Sep. 30, 1992

[86] PCT No.: PCT/NO92/00165

§ 371 Date: May 28, 1993

§ 102(e) Date: May 28, 1993

[87] PCT Pub. No.: WO93/07049

PCT Pub. Date: Apr. 15, 1993

[30] Foreign Application Priority Data

Sep. 30, 1991 [NO] Norway ..... 913825

[51] Int. Cl.[5] ..... B63B 21/52

[52] U.S. Cl. ..... 114/230

[58] Field of Search ..... 114/230; 441/3, 4, 5

[56] References Cited

U.S. PATENT DOCUMENTS

| | | | |
|---|---|---|---|
| 3,264,662 | 8/1966 | Young | 441/5 |
| 3,365,734 | 1/1968 | Petrie et al. | 441/5 |
| 3,407,768 | 10/1968 | Graham . | |
| 3,735,435 | 5/1973 | Mikullcic et al. . | |
| 3,921,557 | 11/1975 | Kapteijn et al. . | |
| 4,142,584 | 3/1979 | Brewer et al. . | |
| 4,359,959 | 11/1982 | Delamare | 114/230 |
| 4,516,881 | 5/1985 | Beynet et al. . | |
| 4,606,727 | 8/1986 | Koenig et al. . | |
| 4,646,841 | 3/1987 | Schawann et al. . | |
| 4,650,431 | 3/1987 | Kentosh . | |
| 4,698,038 | 10/1987 | Key et al. . | |
| 4,701,143 | 10/1987 | Key et al. . | |

FOREIGN PATENT DOCUMENTS

| | | |
|---|---|---|
| 0207915 | 1/1987 | European Pat. Off. . |
| 0399719 | 11/1990 | European Pat. Off. . |
| 165285 | 10/1990 | Norway . |

*Primary Examiner*—Stephen P. Avila

*Attorney, Agent, or Firm*—Wenderoth, Lind & Ponack

[57] ABSTRACT

A turret for a vessel, such as a drilling or production vessel for recovery of oil offshore, is installed in such a manner that it can rotate in a throughgoing opening or well in the hull of the vessel, and includes bearing arms which are equipped with axially and radially fitted bearing elements which act against corresponding bearing elements on the vessel. The bearing arms are connected to a substructure in the turret which provide individual suspension to and can absorb unevennesses and deformations in the bearing. A track of the axial bearing is disposed on a pedestal-like elevated area that is rigid in the axial direction. The pedestal-like elevated area is connected with the hull, mainly at the level of the neutral axis of the vessel, and the radial bearing element on the vessel is in the form of a band-like structure.

16 Claims, 7 Drawing Sheets

TURRET FOR DRILLING OR PRODUCTION SHIP

BACKGROUND OF THE INVENTION

The present invention relates to a turret for a vessel such as a drilling or production vessel for recovery of oil offshore, such turret being erected so as to allow rotation in a throughgoing opening or well in the hull of the vessel, and having suspension arms which are equipped with axially and radially provided bearing elements which operate in relation to corresponding bearing elements on the vessel.

A turret of the abovementioned type is normally fitted with bearing elements with spring devices to assure an even distribution of the bearing forces. The suspension arrangements of the bearings have a fairly large slack, partly to absorb elongation in the vessel, and are often jointed to handle angular deformation and to even out loads. In order to achieve the best possible control of suspension forces and deformation in the bearings, the vessel and rotary or tower turret, complicated mechanical or hydraulic solutions are often used. A hydraulic solution is shown in EP Patent Application No. 0,207,915. It consists of an upper radial bearing, an axial bearing and a lower radial bearing. Each of these bearings consists of a large number of hydraulic piston/-cylinder devices which are each mounted on a bearing element.

One major disadvantage with these solutions is that they are complicated, and therefore expensive to build and maintain. A further disadvantage is that the bearing surfaces are subject to wear as a result of relative movements and constructional deviations which are due to the suspension/bearing wheel arrangement and to movements in the vessel. With regard to the wheel arrangement, because of large relative movements pommelled on curved surface wheels have to be used. These pommelled wheels have limited bearing capacity, and in the case of large, heavy rotary bearing structures, slide bearings therefore have to be used, or a combination of wheel and slide bearings.

One disadvantage with slide bearings, however, is that large machinery is required to turn the turret, and special, expensive precautions have to be taken to protect the bearings against the corrosive environment on board vessels at sea.

Norwegian Patent No. 165,285 shows a bearing system for a turret in which an attempt is made to eliminate the wear and tear on the radial bearing by using a structural suspension. However, this structural suspension has limited independent suspension, particularly in the case of large, heavy turret, which is necessary to maintain a satisfactory load distribution without using special mechanical or hydraulic springs in connection with the axial bearing elements. The wear and tear on the radial bearing surfaces is thus not quite eliminated by this solution.

Further, with regard to the aforementioned Norwegian patent, mechanical suspension is also used in the radial bearing of the turret, and this suspension is, as previously mentioned, costly to build and maintain, and will cause wear and tear on the axial bearing.

SUMMARY OF THE INVENTION

One object of the present invention is to provide a turret for vessels in which the wear and tear on the axial and radial bearings of the turret is virtually eliminated, but which is nevertheless cheaper to build and maintain than existing solutions. Another object is to provide a bearing design for such turret in which vessel-induced stresses and elongations do not induce undesired reaction forces on the bearing and the rotary tower on turret. A third object is to reduce displacements in the turret due to external forces which act thereon. A fourth object is to provide a turret solution in which unevennesses in bearing tracks etc. are absorbed by the substructure of the rotary tower and/or the bearing tracks themselves. Last, but not least, one major object is to provide at a solution which can be used on large, heavy rotary towers which are subject to large forces.

In accordance with the invention, there is provided a turret wherein bearing arms are connected with a substructure in the turret which permits the bearing arms to individually absorb irregularities in the bearing surfaces, the foundation for the bearings for the turret is disposed basically on a level with the neutral axis of the ship, the axial bearing is disposed on a pedestal which is rigid in the axial direction, and is designed to absorb displacements in the radial direction.

BRIEF DESCRIPTION OF THE DRAWINGS

The invention will now be described in more detail by way of example and with reference to the accompanying where.

DETAILED DESCRIPTION OF THE INVENTION

Figure 1:
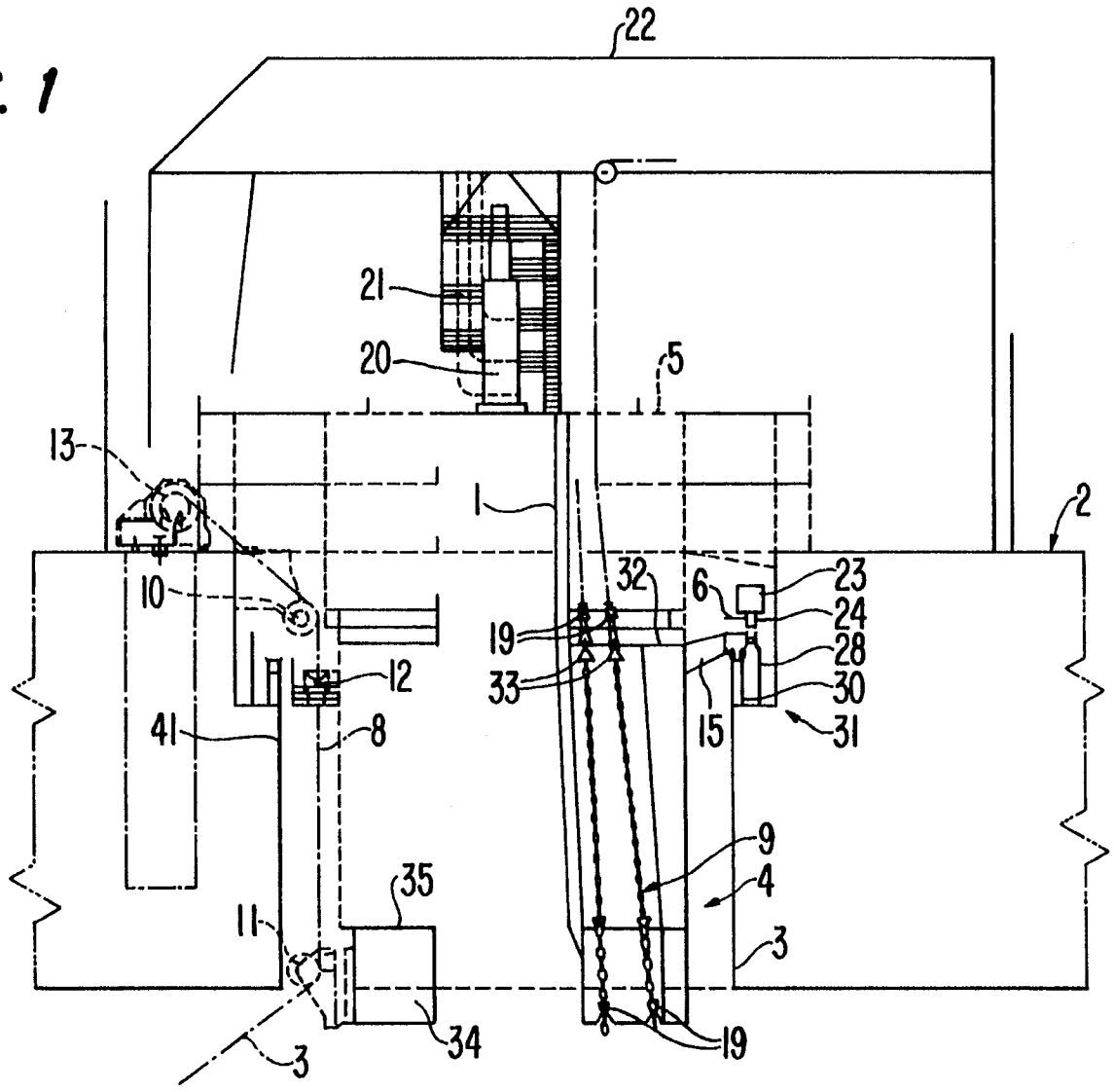
FIG. 1 is a schematic longitudinal section of a turret according to the invention and shown installed in a vessel.

The turret shown in FIG. 1 is mounted in a throughgoing opening or well 3 in a hull 2 of a vessel. A lower part 4 of the turret, i.e. a substructure thereof, includes a substantially cylinder-shaped structure, while an upper part 1 of i.e. a turret, the manifold chamber defining portion, includes a circular deck 5 which provides space for pipe systems and equipment. Oil and gas rises 9 are led through guide pipes 19 up to a choke and manifold system (not shown). A swivel coupling 20 with a set of pipes 21 connects the flow of produced oil and gas from the turret to process equipment of the vessel via a frame structure 22.

The vessel may be dynamically positioned or anchored via mooring lines connected with the turret. In the example shown here, mooring lines 8 are led via a guide wheel 11 on the outside of the turret and are attached to stoppers 12 which are fitted inside the top of the turret. Mooring line lifters 13 mounted on the deck or winches (not shown) mounted on the turret are used to tighten the mooring lines over a guide wheel 10. Alternatively, chain-stoppers instead for a guide wheel 11 can be provided at the lower part of the turret. The guide wheels/chain stoppers 11 should preferably be mounted high (in relation to the base line of the vessel) to reduce capsizing moments due to line elongation and to simplify docking of the vessel.

Turret bearings 28, 31 are arranged in an extended upper part of the well 3 along the neutral axis of the vessel. By arranging the bearings mainly on a level with the neutral axis of the vessel, hull-induced movement in surfaces of the bearings is reduced. A capsizing effect is also reduced, i.e. the distance between the bearings 28, 31 and the guide wheels 11 will be as short as possible.

The turret can be rotated by means of cable lifters 13 via drive chains (not shown in detail) arranged along the circumference of the turret, or a separately rigged rotary device can be used which includes a gear 24 driven by a motor 23. The gear 24 engages with a toothed wheel rim 6 on the turret.

The lower part 4 of the turret includes a solid, ring-shaped box-like support base 35 that forms a foundation for the guide wheel 11 of the mooring lines. Support base 35 has a chamber 34 which preferably may be divided into separate tanks by radial bulkheads. With the aid of a ballast system (discussed below such tanks can be filled or emptied as desired (depending on stretch in the mooring lines) to reduce the capsizing moment of the turret.

Figure 2:
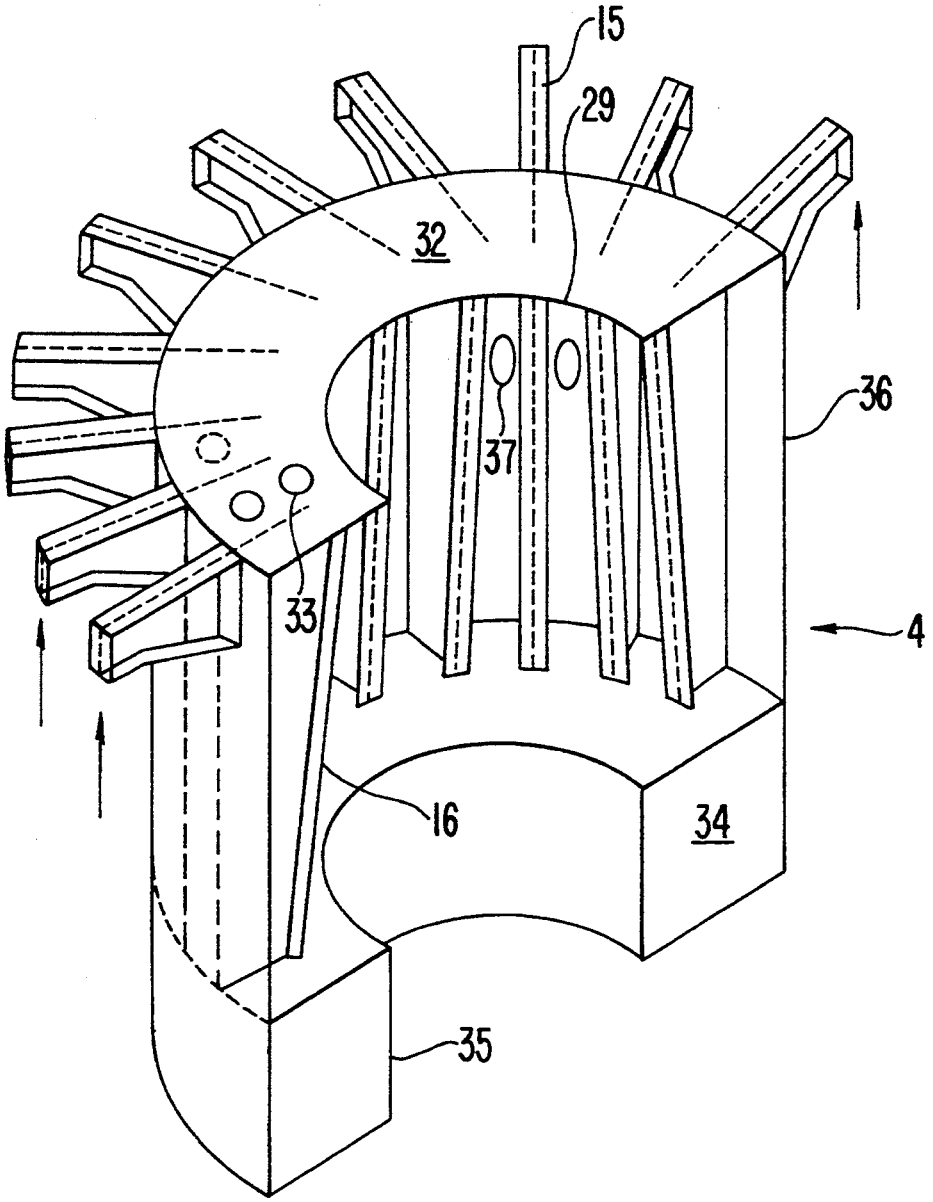
FIG. 2 partial perspective view of substructure of the turret shown in FIG. 1.

FIG. 2 shows that the substructure 4 of the turret includes supports or bearers 16, radial arms 15, a basically cylindrical column 36, the ring-shaped box-like support base 35 and a top plate 32. The radial arms 15 are fastened to respective vertical bearers 16, which in turn are connected to the base support 35. In FIG. 2, the vertical bearers are shown to be T-shaped, but they can with advantage be H-shaped, box-shaped or other appropriate shapes.

The cylindrical column or plate structure 36 between the vertical bearers 16 is largely shear-rigid in a vertical plane, but preferably is flexible in radial directions.

The top plate 32 is shear-rigid, and can be reinforced with a flange ring 29 or similas structure in order to achieve adequate radial rigidity. Apart from that, plate 32 is mainly stiff in the horizontal plane, but preferably is flexible laterally thereof. Plate 32 is also provided with openings 33 for the riser, guide pipes 19 (see FIG. 1).

As mentioned above, each of the radial arms 15 is fixed to a respective vertical bearer or support 16. Moment loading induced by an arm 15 will cause rotation at the point where such arm is fixed, and respective vertical bearer 16 will deflect without affecting adjacent bearers. This is possible because the structures (plate/stiffeners) between the vertical bearers have an insignificant stiffness to deformation in the radial direction of the turret.

With the substructure described above for the turret, one achieves an independent, structural suspension for each of the arms 15, which is necessary to absorb unevennesses in bearing tracks of the bearings. With structural suspension, it will also be advantageous to use wheels in the radial bearing, since major cross-movements of the bearing elements will be avoided in case of large loads. Use of wheels in the axial bearing (also the radial bearing) also reduces rotary moments when the turret rotates.

The proposed substructure thus represents a second important feature of the invention, since it is substantially cheaper than the known solutions which, as mentioned above, use hydraulic or mechanical suspension to absorb the same unevennesses. In this connection it should be mentioned that in Norwegian Patent No. 165,285 a turret with radial arms is used, but such arms are connected to a torque box. This torque box provides flexibility against axial loads which act on the whole turret, since all the arms are fixed to a common box structure. But such arrangement does not contribute substantially to independent deflection which is necessary to absorb unevennesses in the bearing race.

Figure 3:
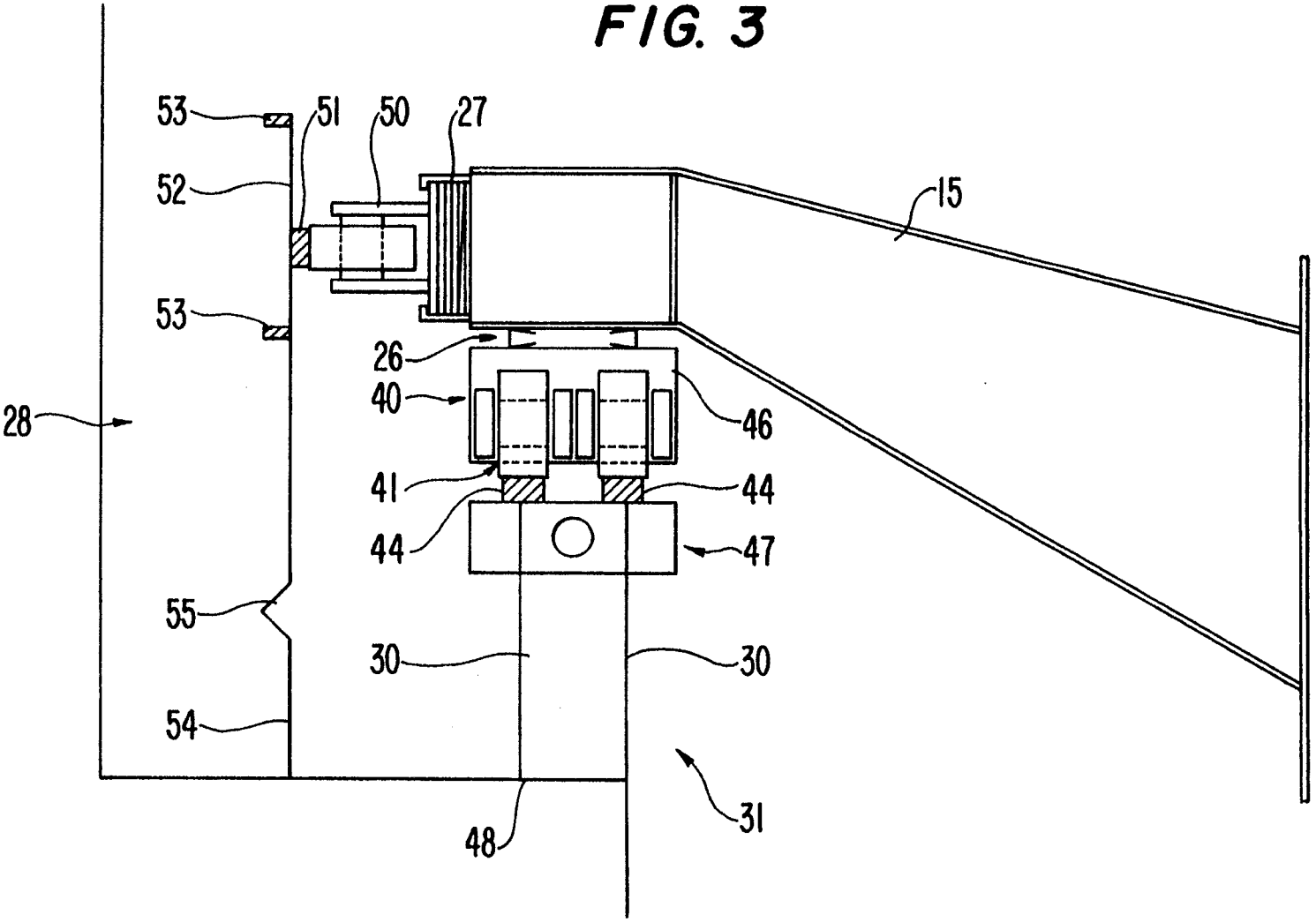
FIG. 3 is a section at a larger scale through a bearing device for the turret.
Figure 4:
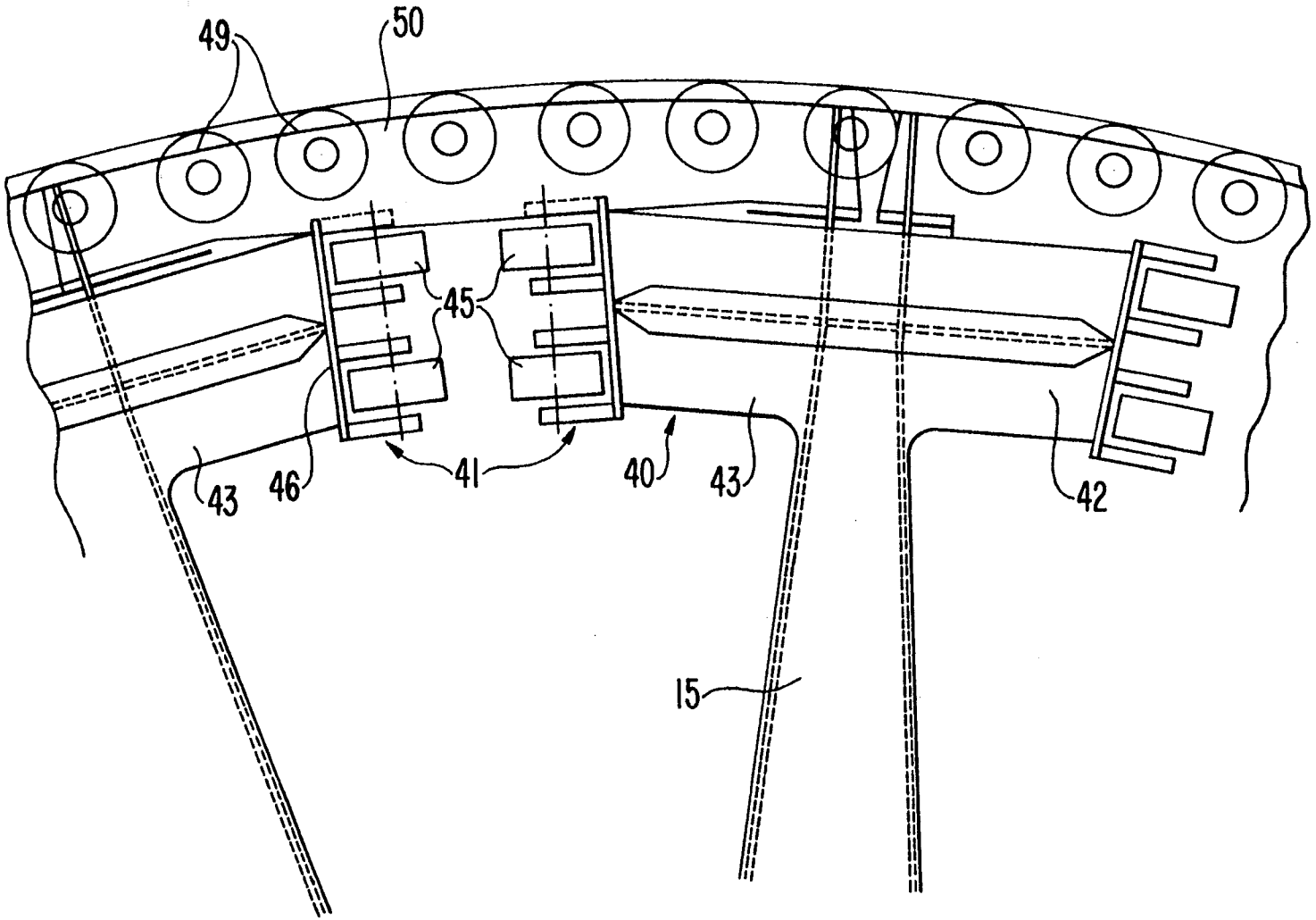
FIG. 4 is an end view of the bearing device as seen from above.

FIGS. 3 and 4 show on enlarged scale the bearing arrangement of the turret. As mentioned previously, the bearing arrangement is largely aligned with the neutral axis of the vessel to reduce hull-induced movements and loads on the bearings.

The bearing arrangement includes radial wheel bearing 28 and axial bearing 31. Bogies 40 attached to each of the arms 15 of the turret are used for the axial bearing. Each bogie includes bogie wheel pairs 41 fastened to each end of a tangential girder 42. Girders 42 are provided with a wide, lower flange or shear plate 43 which is rigid to radial loads from the radial arm 15. The tangential girders are designed mainly to be rigid to loads in the axial direction, but to allow rotation in relation to the radial arm 15. This assures that the tangential girders are rigid to radial and axial deformations, but nevertheless allow an evening out of the load between the four wheels 45 in the bogie. It is important that the girder 42 is flexible enough to tolerate downward bending of the arm 15 without this producing too great reaction loads in the wheels 45. Alternatively, the arms can be built with a certain pre-load angle which is opposite to the downward bending when the turret is subject to maximum loading, the object being that the loads on the wheels are as even as possible when the rotary tower or turret is subject to extreme loads.

The wheels 45 are mounted in a shear-rigid frame 46, so that the wheels are rigid in relation to one another. The wheels 45 can therefore to advantage be made with cylindrical surfaces. A slide bearing should preferably be used in the hub of the wheels to achieve a suitable resistance to rolling and at the same time allow the wheels to slide axially along its axis, in order to absorb relative, radial deformations between the radial bearing and the axial bearing, and to absorb deviations due to construction between the position of the radial bearing and the rails.

Using wheels with cylindrical surfaces has the advantage over curved or pommelled wheels that they have a considerably greater bearing capacity.

The bogie 40 for the axial bearing rolls on a double rail system of rails 44 and the rails in turn rest on a pedestal-like foundation consisting of two cylindrical columns 30, and a ring-shaped or annular torque box 47. Between the box 47, the columns 30 with the necessary bracing and the deck 48, there is no structure which would allow the two shells or columns 30 to be freely deformed in a radial direction. The upper torque box can also be regarded as an upper rigid ring which ensures that the bearing tracks retain their shape locally in the radial plane, while the columns absorb global relative displacements between the bearing tracks and deck support. The plate structure 36 has openings 37 designed to allow air to pass through.

The columns are rigidly supported in the structure of the vessel, well 3 and a support in the deck of the vessel respectively, so that the axial position of the two rails 44 in principle remains at the same elevation when the hull of the vessel is subjected to loads and elongations.

One major advantage with the present foundation design is thus that radial elongations in the hull of the vessel are filtered out by means of a radially flexible spacer, i.e. the columns 30, between the deck 48 of the ship and the bearing tracks 44. This substantially reduces wear on the surfaces of the bearing compared with known solutions. In order to further reduce wear and tear and possibly to increase suspension of the bogies 40 in relation to arms 15, rubber fillers 26 may be inserted between the bogies 40 and the arms 15. These fillers will also eliminate sliding movements in the bearings of the wheels in the bogies 40, and will help to even out the load on the wheels 45.

The radial bearing includes wheels 49 fitted close together in a rim 50 which is connected with the radial arms 15. The wheels 49 run against a radial bearing rail 51 which is fixed to a cylindrical band 52. The band 52 and the rail 51 have a substantial tangential tensile strength, but have local flexibility to minor deviations in the establishment of the mutual radial position of the rail 51 and the wheels. As regards the radial position of the wheels, this can be secured by means of wedge devices 27 which move the wheels in or out in relation to the rim 50, or a kind of cam axle arrangement can be used.

The upper band 52 includes a column shell which extends from the lower edge of the rail up and a bit past top of the rail. This breadth is determined by the necessary tangential strength and radial flexibility of the rail. The band can be strengthened with extra ring-shaped bracers 53 which are placed a certain distance from the rail 51. The foundation for the radial bearing shown includes a column which is an extension of the band 52 down to the deck 48. It can to advantage be made of a thin shell plate 54.

The radial load from the closely mounted radial wheels 49 is transferred to the rail 51/band 52 as tangential forces around the bearing band. Elongation in the band is transferred to the deck of the ship in the range of 45–135 degrees in relation to the load direction, via the lower plate 54. Radial displacement of the turret is therefore limited.

The wheels 49 are mounted in rigid rim 50 on the turret, while the bearing band 51 must be sufficiently flexible to compensate for defects in the rail and wheels. The wheels have to be mounted so close together that limited flexion is caused in the rail/band section.

The advantage of a radial bearing design of the above described type is that the band has enough structural suspension to compensate for local tolerances (unevennesses) in the rail and wheel mounting. The ovalisation of the deck around the well is absorbed in the foundation 54 and/or by means of a certain clearance between rail 51 and wheels 49, so that the radial bearing is maximally loaded as a result of the elongations of the vessel in heavy seas.

The band 52 and the plate of foundation 54 are also in principle so flexible in relation to radial deformations, that global ovalisations (defects) in the turret do not affect the bearing reaction forces to any significant degree.

Alternatively, the band 52 and the foundation 54 may be connected together by means of a coupling 55. The purpose of this coupling is to give the column limited supplemental flexibility in relation to the deck, whereby radial deformations of the well 3 reduce forces in the radial bearing, and that reaction forces in the radial bearing should be less affected by an ovalised turret.

Figure 5:
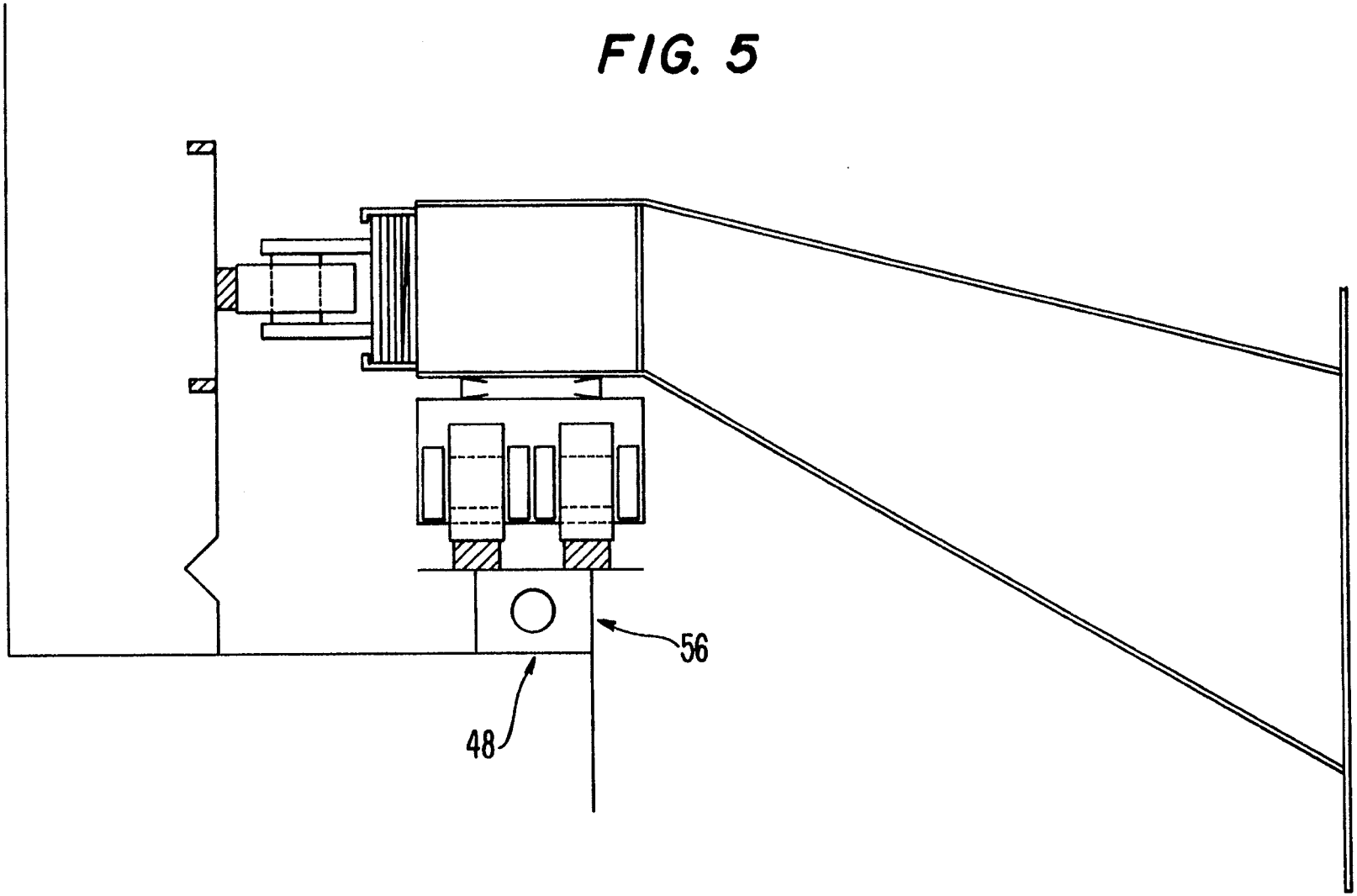
FIGS. 5 and 6 are views similar to FIG. 3 and show two alternative bearing designs.

FIG. 5 shows an example of an alternative design, where a box structure 56 for the axial bearing is provided directly on the deck 48, i.e. without a flexible connection between the deck and the box structure. With this solution, a somewhat lower building height is obtained for the substructure, but there will be somewhat more wear and tear on the bearing surfaces.

Figure 6:
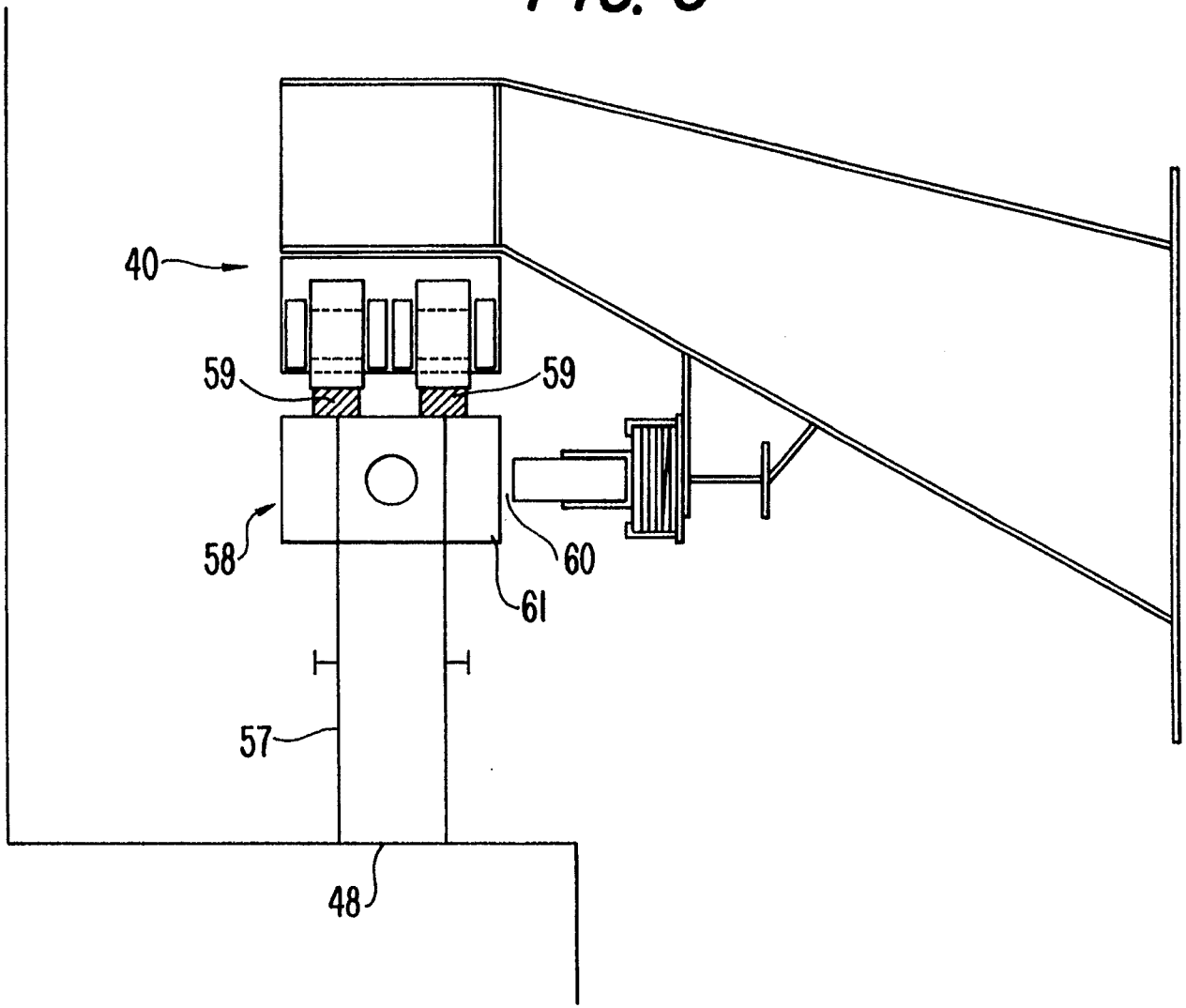

FIG. 6 shows a further bearing solution in which the axial bearing and the radial bearing are provided on a common pedestal 57, and in which a box structure 58 provides support for both rails 59 of the vertical bearing and rail 60 of the radial bearing. An internal plate 61 acts in a manner similar to the band (52, FIG. 3) mentioned above, since it is designed to compensate for minor uneveness in the wheels and rail, i.e. plate 61 is not braced.

The difference between this bearing and the bearing shown in FIGS. 3 and 4 is that a separate column for the radial bearing is eliminated, and the radial bearing is provided at a lower level, which helps to make a capsizing moment from horizontal forces which act on the turret smaller, and less steel for a foundation is needed.

Figure 7:
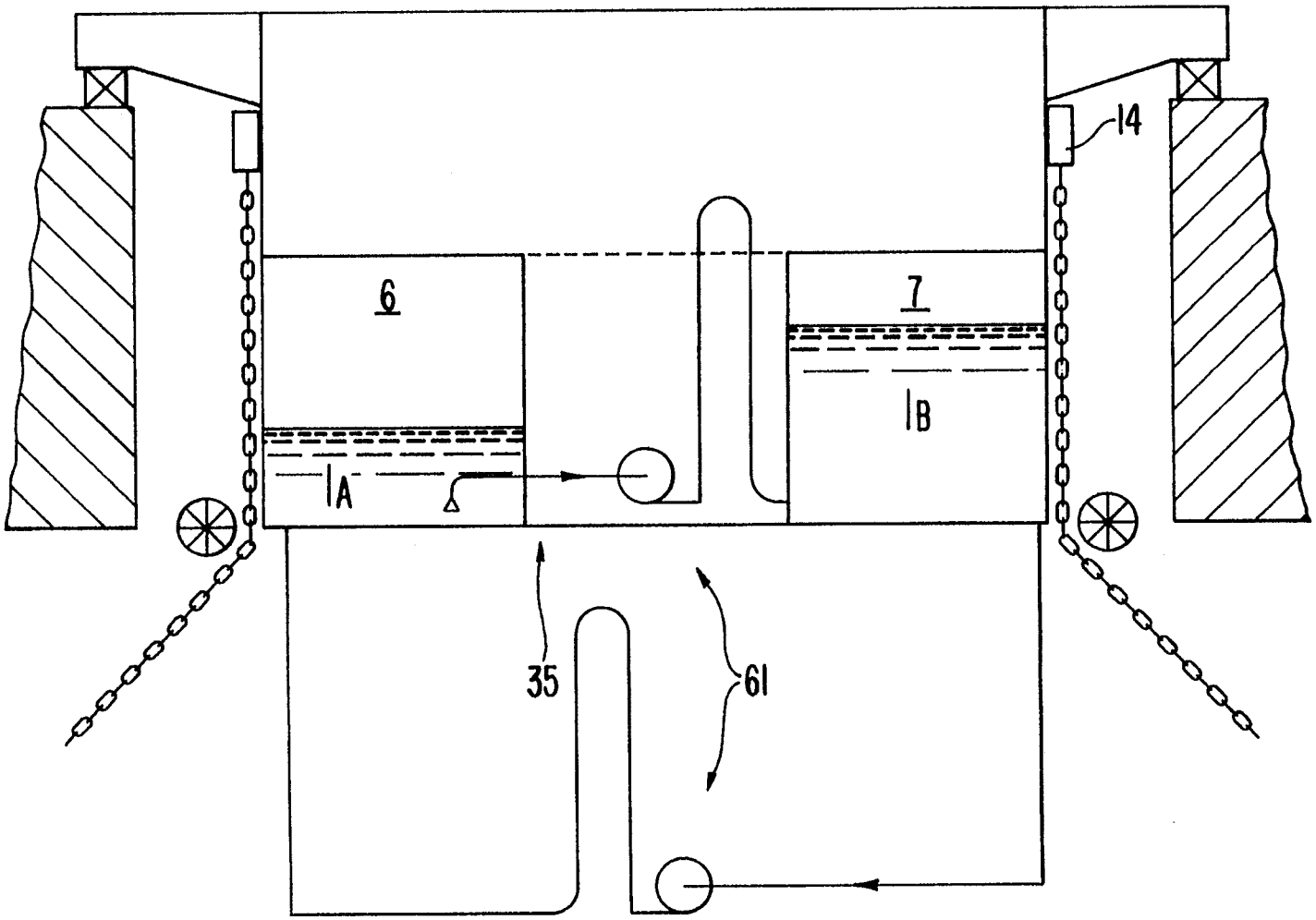
FIG. 7 is a schematic view showing principles of a ballast system for the turret.

FIG. 7 is a sketch showing the principles of the ballast system for the turret, according to the invention. The lower part of the turret consists, as mentioned previously, of a solid, ring-shaped box-like support base 35 which can be divided into separate tanks 6, 7 in the circumferential direction of the turret. With the aid of a pump system and pipelines 61 between the tanks, ballast can be pumped from one or more tanks on one side to one or more tanks on the opposite side to reduce the loads on the bearings and to reduce the capsizing moment of the turret. The pumps can to advantage be controlled by an electronic control unit based on signals from tension detectors 14 on the mooring lines.

The above refers to an example of a turret solution in which wheel mountings are used for both the axial and the radial bearings. However, within the scope of the invention, as defined in the claims, slide bearings can also be used, or a combination of slide and roller bearings.

I claim:

1. In a turret installed in a well in the hull of a vessel such that said turret is rotatable relative thereto, said turret including plural bearing arms supporting axial and radial bearing elements acting on corresponding respective axial and radial bearing track elements on said vessel, the improvement comprising:

said bearing arms being connected to and supported on a substructure of said turret such that each said bearing arm may be flexed individually and independently of adjacent said bearing arms, thereby enabling said bearing arms to individually absorb unevenness and deformations in said bearing elements;

said axial bearing track element being mounted on an elevated area of a pedestal structure mounted on said hull of said vessel, said pedestal structure being rigid axially of said turret; and said radial bearing track element comprising a cylindrical band-shaped member.

2. The improvement claimed in claim 1, wherein said pedestal structure is mounted on and extends upwardly from a deck of said vessel.

3. The improvement claimed in claim 1, wherein said elevated area of said pedestal structure is at a level of the neutral axis of said vessel.

4. The improvement claimed in claim 1, wherein said pedestal structure includes an annular rigid torque box.

5. The improvement claimed in claim 4, wherein said torque box is mounted directly on a deck of said vessel.

6. The improvement claimed in claim 4, wherein said torque box is connected to a deck of said vessel by at least one annular column extending upwardly from a deck of said vessel.

7. The improvement claimed in claim 6, comprising two said columns spaced radially of each other.

8. The improvement claimed in claim 7, wherein said band-shaped member comprises a radially inner wall of said torque box.

9. The improvement claimed in claim 1, wherein said band-shaped member comprises an annular column connected with a deck of said vessel by a foundation in the form of a thin shell plate.

10. The improvement claimed in claim 9, wherein said column and said foundation are connected by a coupling.

11. The improvement claimed in claim 9, wherein said column is reinforced by ring-shaped braces.

12. The improvement claimed in claim 1, wherein both said axial and radial bearing comprise roller bearings.

13. The improvement claimed in claim 1, wherein each said bearing arm has mounted thereon a bogie, said axial bearing track element comprises two parallel rails, and each said axial bearing element comprises paris of roller bearings mounted on opposite circumferential ends of a respective said bogie and running on respective said rails.

14. The improvement claimed in claim 1, wherein said radial bearing elements comprise roller bearings mounted close together on a rigid rim connected to said bearing arms.

15. The improvement claimed in claim 1, wherein said substructure comprises a lower ring-shaped support base, a cylindrical column extending upwardly from said support base, plural vertical supports extending upwardly from said support base within said column, said bearing arms being connected to respective said vertical supports, and an upper top plate.

16. The improvement claimed in claim 15, wherein said support base has therein a chamber divided by bulkheads into separate ballast tanks.

* * * * *